US007242241B2

(12) United States Patent
Toumazou et al.

(10) Patent No.: US 7,242,241 B2
(45) Date of Patent: Jul. 10, 2007

(54) REFERENCE CIRCUIT

(75) Inventors: Christofer Toumazou, Oxford (GB); Julius Georgiou, Nicosia (CY)

(73) Assignee: DNA Electronics Limited, London (GB)

( * ) Notice: Subject to any disclaimer, the term of this patent is extended or adjusted under 35 U.S.C. 154(b) by 27 days.

(21) Appl. No.: 10/514,243

(22) PCT Filed: May 19, 2003

(86) PCT No.: PCT/GB03/02156

§ 371 (c)(1),
(2), (4) Date: Jul. 14, 2005

(87) PCT Pub. No.: WO03/098368

PCT Pub. Date: Nov. 27, 2003

(65) Prior Publication Data

US 2006/0033557 A1 Feb. 16, 2006

(30) Foreign Application Priority Data

May 21, 2002 (GB) ..... 0211564.0

(51) Int. Cl.
*G05F 3/26* (2006.01)
*G05F 3/24* (2006.01)

(52) U.S. Cl. ..... 327/543; 323/315

(58) Field of Classification Search ..... None
See application file for complete search history.

(56) References Cited

U.S. PATENT DOCUMENTS 4,300,091 A 11/1981 Schade et al. ..... 323/315
4,777,019 A 10/1988 Dandekar ..... 422/82.02
5,103,159 A * 4/1992 Breugnot et al. ..... 323/315
5,466,348 A 11/1995 Holm-Kennedy ..... 205/775
5,632,957 A 5/1997 Heller et al. ..... 422/68.1
5,635,869 A * 6/1997 Ferraiolo et al. ..... 327/543
5,644,216 A * 7/1997 Lopez et al. ..... 323/315
5,793,248 A * 8/1998 Lee et al. ..... 327/543
5,827,482 A 10/1998 Shieh et al. ..... 422/82.02
5,939,933 A * 8/1999 Wang ..... 327/512
6,015,714 A 1/2000 Baldarelli et al. ..... 436/2

(Continued)

FOREIGN PATENT DOCUMENTS

EP 0 483 537 A2 10/1991

(Continued)

OTHER PUBLICATIONS

Sakurai and Husimi, "Real-Time Monitoring of DNA Polymerase Reactions by a Micro ISFET pH Sensor," Anal. Chem, 64, pp. 1996-1997 (1992).

*Primary Examiner*—Timothy R Callahan
*Assistant Examiner*—Terry L. Englund
(74) *Attorney, Agent, or Firm*—Synnestvedt & Lechner LLP

(57) ABSTRACT

A reference circuit comprising first and second field effect transistors connected to form a first current mirror, and third and fourth field effect transistors connected to form a second current mirror, wherein a property of the first transistor is mismatched relative to the second transistor such that the threshold voltage of the first transistor is significantly higher than the threshold voltage of the second transistor, and the drain current versus gate-source voltage responses of the first and second transistors have substantially different gradients for current levels at which the reference circuit is operated.

16 Claims, 2 Drawing Sheets

U.S. PATENT DOCUMENTS

| | | | | |
|---|---|---|---|---|
| 6,060,327 | A | 5/2000 | Keen | 204/403.14 |
| 6,096,610 | A | 8/2000 | Alavi et al. | 438/286 |
| 6,333,662 | B1 * | 12/2001 | Umezawa et al. | 327/333 |
| 6,413,792 | B1 | 7/2002 | Sauer et al. | 438/49 |
| 6,953,958 | B2 | 10/2005 | Baxter et al. | 257/253 |
| 2001/0020844 | A1 | 9/2001 | Andoh et al. | 323/316 |
| 2003/0186262 | A1 | 10/2003 | Cailloux | 435/6 |
| 2004/0262636 | A1 | 12/2004 | Yang et al. | 257/200 |
| 2005/0032075 | A1 | 2/2005 | Yaku et al. | 435/6 |
| 2005/0062093 | A1 | 3/2005 | Sawada et al. | 257/316 |

FOREIGN PATENT DOCUMENTS

| | | |
|---|---|---|
| EP | 0 992 871 A2 | 4/2000 |
| FR | 2 732 129 A1 | 3/1995 |

* cited by examiner

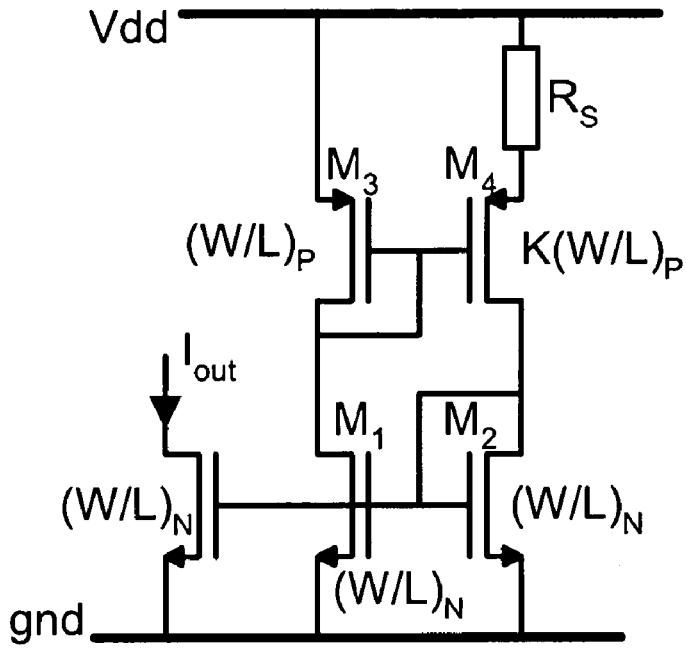
FIGURE 1- PRIOR ART
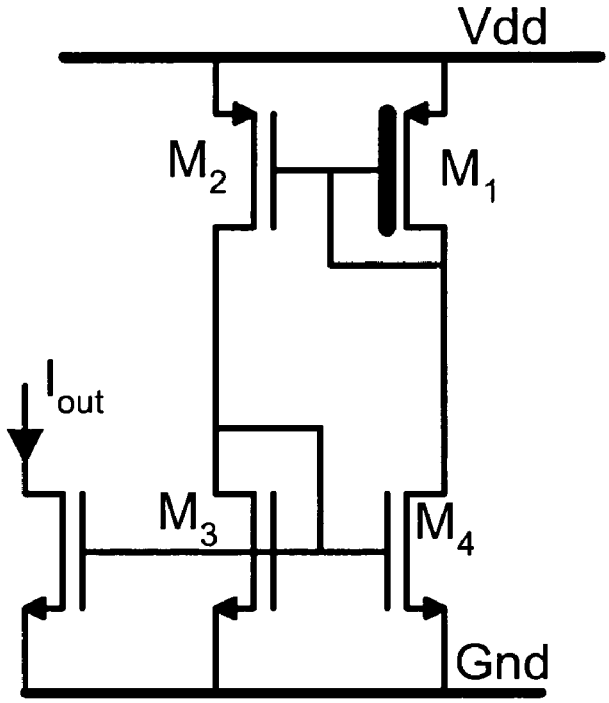
FIGURE 2

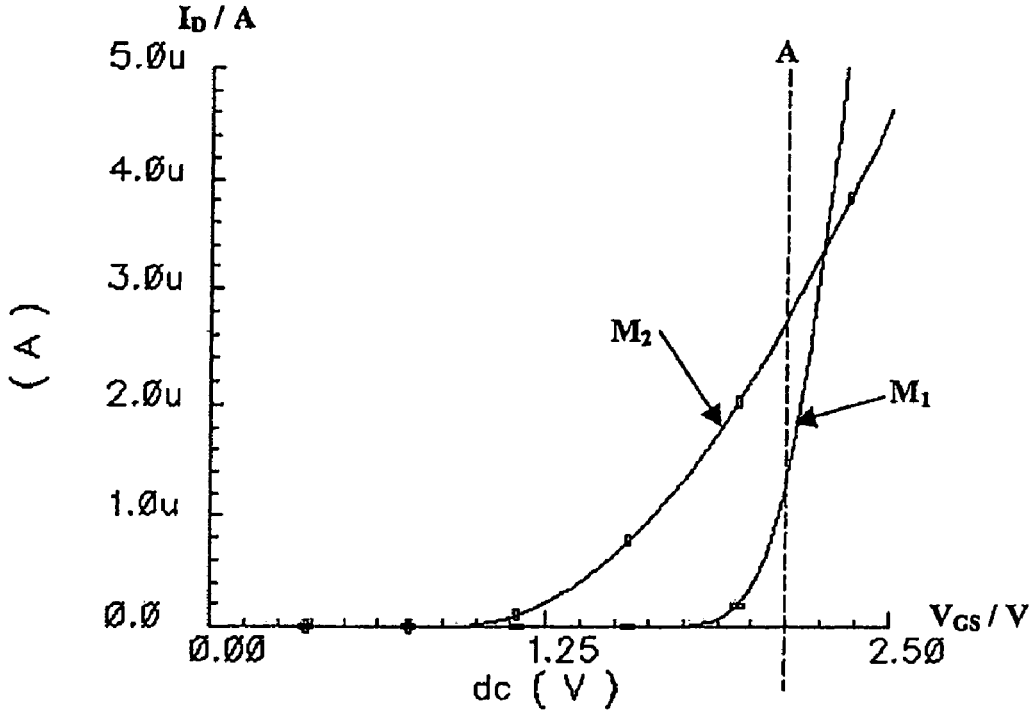
FIGURE 3
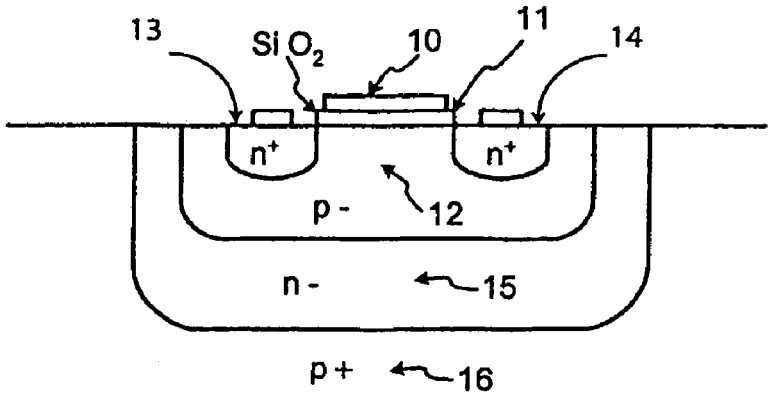
FIGURE 4 – Prior Art

REFERENCE CIRCUIT

CROSS-REFERENCE TO RELATED APPLICATION

This application is a National Stage entry of International Application Number PCTGB03/02156, filed May 19, 2003. The disclosure of the prior application is hereby incorporated herein in its entirety by reference.

The present invention relates to a reference circuit, and particularly though not exclusively to a reference circuit suitable for providing a current.

Current reference circuits are fundamental building blocks of integrated circuits, and biasing for most integrated circuits can be traced back to an on-chip current reference circuit.

A conventional prior art current reference circuit [1] is shown in FIG. 1. The circuit comprises two pairs of field effect transistors (FETs) and a resistor. The first pair of FETs, $M_1$ and $M_2$, are matched and are n-channel FETs. They form a first current mirror that maintains equal currents in the drains of $M_3$ and $M_4$. The term 'matched pair' refers to the fact that $M_1$ and $M_2$ are constructed such that their properties are as identical as possible. A second pair of FETs $M_3$ and $M_4$ are p-channel FETs, and form a current mirror-like structure of non-unity gain, which is connected to the first current mirror. $M_4$ is K times wider than $M_3$, and has a resistance $R_S$ connected between the source terminal and Vdd, the positive supply rail. The first current mirror and the current mirror-like structure are connected together to minimise the effect of supply voltage variation upon the current provided. Neglecting secondary effects, the size of the current generated by the prior art reference circuit is determined by the magnitude of a resistor $R_S$, the mobility $\mu_h$ of the holes of the PMOS devices, the gate oxide capacitance per unit area $C_{ox}$, the ratio K between the width of $M_3$ and $M_4$, and the aspect ratio (W/L) of the PMOS devices according to the following relationship:

therefor $$I_{out} = \frac{2}{\mu_n C_{ox}(W/L)_P} \cdot \frac{1}{R_S^2}\left(1 - \frac{1}{\sqrt{K}}\right)^2$$

The prior art circuit shown in FIG. 1 suffers from the disadvantage that a large resistor, necessary for producing small reference currents, cannot easily be incorporated into an integrated circuit design (it usually occupies a substantial chip area). This is particularly the case in implanted bio-medical applications, where the current required to be generated by a current reference circuit is very small, typically of the order of nanoamperes, and the magnitude of resistor $R_s$ needed to provide the current is correspondingly large. The area occupied by a resistor of suitable magnitude may be prohibitive for bio-medical applications.

Alternative reference circuits based on replacing the resistor with active devices have been proposed [2][3][4], but these circuits are much more complicated and occupy substantial chip areas.

It is an object of the present invention to provide a reference circuit that overcomes or mitigates one or more of the above disadvantages.

According to the invention there is provided a reference circuit comprising first and second field effect transistors connected to form a first current mirror, and a third and fourth field effect transistors connected to form a second current mirror, wherein a property of the first transistor is mismatched relative to the second transistor such that the threshold voltage of the first transistor is significantly higher than the threshold voltage of the second transistor, and the drain current versus gate-source voltage responses of the first and second transistors have substantially different gradients for current levels at which the reference circuit is operated.

Suitably, the property of the first transistor is selected such that, for a particular voltage applied to the common gate of the first transistor and the second transistor, the second transistor operates substantially in its strong inversion saturation region whilst the first transistor operates substantially in its weak inversion saturation region.

Suitably, the mismatch is obtained by providing the first transistor with an oxide layer having a thickness which is greater than the oxide layer of the second transistor.

Suitably, the thickness of the oxide layer provided on the first transistor is at least twice the thickness of the oxide layer provided on the second transistor.

Suitably, the thickness of the oxide layer provided on the first transistor is at least 5 nanometers greater than the thickness of the oxide layer provided on the second transistor.

Suitably, the thickness of the oxide layer provided on the first transistor is at least 10 nanometers greater than the thickness of the oxide layer provided on the second transistor.

Suitably, the mismatch is obtained by providing more doping to the substrate of the first transistor than the substrate of the second transistor.

Suitably, the first transistor comprises a modified twin tub configuration, in which a well layer separating an upper tub layer and a substrate layer is omitted during fabrication such that the upper tub layer is located directly on the substrate layer, the upper tub layer thereby providing a substrate layer having increased doping.

Suitably, the third and fourth transistors are matched such that either side of the second current mirror is constrained to draw substantially the same current, the circuit having a stable operating point where the drain current versus gate-source voltages of the first and second transistors intersect.

Suitably, the third and fourth transistors are not matched, so that one side of the second current mirror is constrained to draw more current than the other side.

Suitably, the third and fourth transistors are field effect transistors, and the width of the channel of one of the transistors is selected to be different to the width of the channel of the other transistor so that that side of the current mirror is constrained to draw a current which is a ratio of the current on the other side.

Suitably, the third and fourth transistors are field effect transistors, and the length of the channel of one of the transistors is selected to be different to the length of the channel of the other transistor so that that side of the current mirror is constrained to draw a current which is a ratio of the current on the other side.

Suitably, the third and fourth transistors are bipolar transistors.

Suitably, the length of the first transistor is selected to be different to the length of the second transistor.

Suitably, the width of the first transistor is selected to be different to the width of the second transistor.

Suitably, a reference voltage is obtained from the common gate of the third and fourth transistors.

Suitably, a copy of the reference current is obtained by connecting a FET to the common gate of the third and the fourth transistor.

Suitably, the first and second transistors are p-channel field effect transistors, and the third and fourth transistors are n-channel field effect transistors.

A specific embodiment of the invention will now be described by way of example only, with reference to the accompanying figures in which:

FIG. 1 is a circuit diagram which represents a conventional prior art current reference circuit;

FIG. 2 is a circuit diagram which represents a current reference circuit according to the invention;

FIG. 3 is a graph which illustrates drain current versus gate-source voltage responses of field effect transistors of the circuit shown in FIG. 2; and FIG. 4 is a schematic illustration of a prior art twin tub field effect transistor.

Referring to FIG. 2, a circuit according to the invention comprises two n-channel field effect transistors $M_3$ and $M_4$ connected to form a first current mirror, and two p-channel field effect transistors $M_1$ and $M_2$ connected to form a second current mirror. The sources of the p-channel transistors $M_1$ and $M_2$ are connected to a voltage rail $V_{dd}$ which provides between 3.5 and 5 volts (the voltage source may be for example a lithium battery which provides 4 volts). The sources of the n-channel transistors $M_3$ and $M_4$ are connected to ground.

In a conventional arrangement the field effect transistors $M_1$ and $M_2$ would be of different width and have a resistor in series with $M_1$ such that, for a given gate voltage, the current provided from the drain of each of the transistors is equal. However, in the circuit shown in FIG. 2 the transistors $M_1$ and $M_2$ have no need for a series resistance, but instead the thickness of the oxide layer provided on transistor $M_1$ is significantly thicker than the oxide thickness provided on transistor $M_2$. In one embodiment of the invention the thickness of the oxide layer on $M_2$ is 17 nanometers, whereas the thickness of the oxide layer on $M_1$ is 40 nanometers. The effect of the oxide thickness mismatch is that the threshold voltage of $M_1$ is much greater than that of $M_2$.

In operation, $M_2$ is turned on first and enters the square law saturation region (i.e. the rate of increase of current with respect to gate source voltage is quadratic). $M_1$ is weakly turned on at a higher voltage, and operates in the weak inversion region (i.e. the rate of increase of current with respect to gate source voltage is exponential). Since $M_1$ is turned on at a higher voltage than $M_2$, and provides current which increases with a steeper gradient, it follows that there is a value of gate voltage for which both $M_1$ and $M_2$ provide the same output current. This is the stable operating point of the circuit, given that the gain of the current mirror comprising of $M_3$ and $M_4$ is unity.

It will be understood that the output current of the reference circuit is stable, under stable ambient conditions. If the ambient conditions, e.g. the temperature varies, then the output current of the reference circuit may vary accordingly. This property may be used to provide a reference current which tracks changes in ambient conditions.

FIG. 3 is a graph that represents drain current as a function of gate source voltage for both $M_1$ and $M_2$. Referring to FIG. 3, $M_2$ enters the weak inversion region at a gate source voltage of around 0.3V. The current provided by $M_2$ at 0.3V is very low, and consequently is not apparent in FIG. 3. $M_2$ enters the square law saturation region at around 0.9V, and remains in the square law saturation region up to 2.5V and beyond as is apparent from FIG. 3.

$M_1$ enters the weak inversion region at a gate source voltage of around 1.6V, and remains in the weak inversion region over the range of currents represented in FIG. 3. Since $M_1$ remains in the weak inversion region, the current provided by $M_1$ rises exponentially.

The currents provided by $M_1$ and $M_2$ intersect at a value of approximately 3.21 μA for a gate source voltage of approximately 2.25V. This intersection provides a current which satisfies the operating requirements of the current mirror formed by n-channel transistors $M_3$ and $M_4$, i.e. that the current provided by each side of the circuit is equal. The intersection is a stable operating point for the circuit, and the circuit will consequently generate a fixed current of approximately 3.2 μA which is independent of the voltage $V_{dd}$ at the bias rail.

The currents provided by $M_1$ and $M_2$ will not intersect at higher values, since the gradient of $M_1$ will never be less than the gradient of $M_2$ ($M_1$ will eventually enter the square law saturation region). This means that the circuit has no stable operating points at higher currents. The currents provided by $M_1$ and $M_2$ will converge at zero gate-source voltage and zero current, therefore this could be considered to be a stable operating point of the circuit. The circuit will leave the zero current operating point given a sufficient voltage at $V_{dd}$ and an initial startup charge at the gates of $M_3$ and $M_4$ and move to the stable intended operating point which generates the approximately 3.2 μA current, in this particular case. Leakage currents can sometime be sufficient to start-up the circuit.

Different current settings for the circuit may be achieved by scaling the response of $M_1$ and $M_2$ with respect to each other. For example, by providing $M_1$ with a thicker oxide layer, the voltage at which $M_1$ is weakly turned on will increase, and the current provided by the stable operating point will increase.

The quadratic behaviour of a field effect transistor operating in the square law saturation region is determined by the following:

$$I_d = \frac{\mu_h C_{ox} W}{L}(V_{gs} - V_T)^2$$

where $I_d$ is the drain current, $\mu_h$ is the mobility of holes, $C_{ox}$ is the capacitance per unit area of the gate, W is the width of the channel, L is the length of the channel, $V_{gs}$ is the gate/source voltage and $V_T$ is the threshold voltage.

The exponential behaviour of a field effect transistor operating in the weak inversion region is determined by the following:

$$I_d = I_k\left(\frac{W}{L}\right)\exp(V_{gs}/nV_T)$$

where $I_d$ is the drain current, $I_k$ is a constant, W is the width of the channel, L is the length of the channel, n is a constant, $V_{gs}$ is the gate/source voltage and $V_T$ is the threshold voltage.

From the above it is clear that different current settings for the circuit may be achieved by modifying the channel width and/or the channel length of the transistors, and in particular by selecting the ratio of width to length. For example, referring to FIG. 2, if the width W of the channel of $M_2$ were to be doubled then the current provided by the circuit would double. Similarly, if the length L of the channel of $M_2$ were to be doubled then the current provided by the circuit would halve.

The modification of the width or length need not be confined to the p-channel transistors $M_1$ and $M_2$, but may instead be used to adjust the properties of the n-channel transistors $M_3$ and $M_4$. For example, instead of matching $M_3$ and $M_4$, the channel width of $M_3$ could be double of $M_4$. This would constrain the circuit to provide twice as much current on the left hand side as on the right hand side. The stable operating point of the circuit would then be at approximately 2.13 volts as indicated by the vertical line A in FIG. 3. Where n-channel transistors $M_3$ and $M_4$ are not matched, it will be appreciated that there is no requirement for the drain currents $M_1$ and $M_2$ to be identical.

One suitable combination of channel widths and channel lengths is as follows:

| | | | |
|---|---|---|---|
| $M_2$: | Width = 2<br>Length = 10 | $M_1$: | Width = 40<br>Length = 5 |
| $M_3$: | Width = 2<br>Length = 20 | $M_4$: | Width = 2<br>Length = 20 |

Since $M_3$ and $M_4$ are matched, the stable operating point of the circuit is the point at which $M_1$ and $M_2$ provide the same current. The large channel width of $M_1$ compared to $M_2$ is necessary since the threshold voltage of $M_1$ is much higher than that of $M_2$.

The circuit may be used to generate a reference current via a copy of the drain current of $M_3$ by connecting yet another matched device to the common gate of $M_1$ and $M_2$. Alternatively, the gate voltage of $M_1$ and $M_2$, can be used as a reference voltage.

In the described embodiment of the invention the transistors are field effect transistors. It will be appreciated that any suitable field effect transistors may be used. $M_1$ and $M_2$ could be bipolar transistors, for example where biCMOS is used.

The invention may be implemented as a single semiconductor chip, making it particularly suited to biomedical applications.

In the above mentioned semiconductor technology process, the chip has a standard feature size of 0.8 μm, and the low voltage field effect transistors provided on the chip has a typical standard gate oxide layer of around 17 nm. Where the invention is used, the mid-gate oxide layer of transistor $M_1$ is approximately 50 nm. Some semiconductor manufacturers already provide transistors with oxide layers of similar this thickness, for use in high voltage processors (high voltage typically means around 20–30V rather than a normal voltage of around 5.5V). It would be possible therefore to manufacture a chip which incorporates the invention using existing techniques.

For a semiconductor chip having a standard feature size of 0.25 μm, the field effect transistors provided on the chip will have an oxide layer of around 5 or 6 nm. Where the invention is used, the oxide layer of transistor $M_1$ could be approximately 13 nm. Again, a chip that incorporates the invention could be manufactured using existing manufacturing processes that support two different voltages e.g. 3V and 5V devices.

An alternative, or additional, means of modifying the threshold voltage of transistor $M_1$ is by modifying the doping of the substrate. An increase of the doping of the substrate will cause a corresponding increase of the threshold voltage required to invert the channel of the transistor.

One manner in which the substrate doping may be increased in a silicon chip is by modifying a conventional twin tub field effect transistor configuration. A prior art twin tub FET is shown in FIG. 4. The FET comprises a contact 10 and silicon oxide layer 11, located on top of a negatively doped p-tub 12. Positively doped n+ source 13 and drain 14 regions are provided at either side of the silicon oxide layer 11. The entire p-well 12 is located in a negatively doped n-well 15. The n-well 15 is located in a positively doped p-substrate 16. The n-well 15 isolates the p-well 12 from the p-substrate 16, providing the FET with advantageous features, and this is why the twin tub FET is used in prior art silicon chips.

The invention may be implemented by omitting the n-well 15 during fabrication of the FET, so that the p-well layer lies directly over the p-substrate layer. The effect of doing this will be to provide a conventionally configured FET having a substrate layer which is more strongly doped than the substrate layers of other FET's provided on the chip. The threshold of the FET is increased by the higher doping of the p-substrate.

Use of technologies with two different gate oxide thickness is preferred over modification of the doping because the oxide thickness is better controlled and supplied device models are more accurate.

Where different gate oxide thickness devices are used to implement the invention, the thicknesses should be carefully controlled in order to ensure that the invention functions correctly. The thickness of the oxide layer provides separation of the current versus gate source voltage curves as shown in FIG. 3. If the thicknesses of the oxide layers are very close, then small changes of the doping or device size may influence the operation of the invention. Thus, it is preferred to provide oxide layers having very different thicknesses, for example a difference of a factor of two or greater.

It will be appreciated by those skilled in the art that the circuit shown in FIG. 2 may be constructed in an 'opposite' sense by replacing n-channel transistors with p-channel transistors, and vice versa. Other modifications of the invention will be apparent to those skilled in the art.

REFERENCES

[1] B. Razavi, "Design of Analog CMOS Integrated Circuits", McGraw Hill, 2000

[2] W. M. Sansen et all "A New CMOS current reference", in Proc. ESSCIRC'87, p125

[3] W. M. Sansen, F. O. Eynde and M. Steyaert, "A CMOS Temperature Compensated Current Reference", IEEE J. of Solid-State Circuits, Vol. 23, No. 3, June 1988.

[4] H. Oguey, "Generateur de courant de reference en technologie CMOS", French patent application no 9503352, Mar. 22, 1995.

The invention claimed is:

1. A reference circuit comprising first and second field effect transistors connected to form a first current mirror, and third and fourth field effect transistors connected to form a second current mirror, the drains of the first and second transistors being coupled to the drains of the third and fourth transistors respectively, wherein a property of the first transistor is mismatched relative to the second transistor such that the threshold voltage of the first transistor is significantly higher than the threshold voltage of the second transistor, and the drain current versus gate-source voltage responses of the first and second transistors have substantially different gradients for current levels at which the reference circuit is operated so that, for a particular voltage applied to the common gate of the first transistor and the second transistor, the second transistor operates substantially in its strong inversion saturation region whilst the first transistor operates substantially in its weak inversion saturation region to allow a constant current to be generated.

2. A reference circuit according to claim 1, wherein the mismatch is obtained by providing the first transistor with an oxide layer having a thickness which is greater than the oxide layer of the second transistor.

3. A reference circuit according to claim 2, wherein the thickness of the oxide layer provided on the first transistor is at least twice the thickness of the oxide layer provided on the second transistor.

4. A reference circuit according to claim 2, wherein the thickness of the oxide layer provided on the first transistor is at least 5 nanometers greater than the thickness of the oxide layer provided on the second transistor.

5. A reference circuit according to claim 3, wherein the thickness of the oxide layer provided on the first transistor is at least 10 nanometers greater than the thickness of the oxide layer provided on the second transistor.

6. A reference circuit according to claim 1, wherein the mismatch is obtained by providing more doping to the substrate of the first transistor than the substrate of the second transistor.

7. A reference circuit according to claim 6, wherein the first transistor comprises a modified twin tub configuration, in which a well layer separating an upper tub layer and a substrate layer is omitted during fabrication such that the upper tub layer is located directly on the substrate layer, the upper tub layer thereby providing a substrate layer having increased doping.

8. A reference circuit according to claim 1, wherein the third and fourth transistors are matched such that either side of the second current mirror is constrained to draw substantially the same current, the circuit having a stable operating point where the drain current versus gate-source voltages of the first and second transistors intersect.

9. A reference circuit according to claim 1, wherein the third and fourth transistors are not matched, so that one side of the second current mirror is constrained to draw more current than the other side.

10. A reference circuit according to claim 9, wherein the width of the channel of one of the third and fourth transistors is selected to be different to the width of the channel of the other of the third and fourth transistors so that the third transistor side of the second current mirror is constrained to draw a current which is a ratio of the current on the fourth transistor side.

11. A reference circuit according to claim 9, wherein the length of the channel of one of the third and fourth transistors is selected to be different to the length of the channel of the other of the third and fourth transistors so that that the third transistor side of the second current mirror is constrained to draw a current which is a ratio of the current on the fourth transistor side.

12. A reference circuit according to claim 1, wherein the length of the first transistor is selected to be different to the length of the second transistor.

13. A reference circuit according to claim 1, wherein the width of the first transistor is selected to be different to the width of the second transistor.

14. A reference circuit according to claim 1, wherein a reference voltage is obtained from the common gate of the third and fourth transistors.

15. A reference circuit according to claim 1, wherein a copy of the reference current is obtained by connecting a FET to the common gate of the third and the fourth transistors.

16. A reference circuit according to claim 1, wherein the first and second transistors are p-channel field effect transistors, and the third and fourth transistors are n-channel field effect transistors.

* * * * *